United States Patent [19]

Lisiecki

[11] Patent Number: 5,029,713

[45] Date of Patent: Jul. 9, 1991

[54] FLAT TOP CONTAINER

[75] Inventor: Robert E. Lisiecki, W. Bloomfield, Mich.

[73] Assignee: Elopak Systems, A.G., Glattbrugg, Switzerland

[21] Appl. No.: 568,179

[22] Filed: Aug. 16, 1990

[51] Int. Cl.[5] ..... B65D 5/70

[52] U.S. Cl. ..... 206/626; 206/621.6; 206/622; 229/169

[58] Field of Search ..... 206/607, 621, 621.6, 206/622, 626, 631, 633; 229/169

[56] References Cited

U.S. PATENT DOCUMENTS

| | | | |
|---|---|---|---|
| 2,581,237 | 1/1952 | Casler | 229/169 |
| 2,663,981 | 12/1953 | Sanford | 206/626 |
| 2,702,152 | 2/1955 | Britton | 229/169 |
| 2,730,288 | 1/1956 | Dixon | 206/626 |
| 2,730,289 | 1/1956 | Dixon | 229/169 |
| 2,819,832 | 1/1958 | Stoller et al. | 206/622 |
| 3,128,032 | 4/1964 | Hill | 206/626 |
| 3,395,848 | 8/1968 | Johnson | 206/626 |
| 4,520,930 | 6/1985 | Lisiecki | 206/633 |

*Primary Examiner*—Gary E. Elkins
*Attorney, Agent, or Firm*—John P. Moran

[57] ABSTRACT

The drawings and description disclose a thermoplastic coated rectangular cross-section paperboard container suitable for being filled with milk, juice or other still beverage, and having a top closure arrangement adapted to being readily partially opened to disclose a pouring opening therein. The top closure arrangement includes four inwardly sloping connector panels intermediate the front, back and side panels and a flat top configuration having the opening apparatus formed thereon.

6 Claims, 6 Drawing Sheets

FLAT TOP CONTAINER

TECHNICAL FIELD

This invention relates generally to thermoplastic coated paperboard containers and, more particularly, to a top end closure of an improved flat top construction.

BACKGROUND ART

Containers for beverages such as milk, cream, other dairy products, juices, and the like, are conventionally constructed from thermoplastic coated paperboard. Typically, these containers include a top end closure with a folded gable roof having a vertically projecting seal at the roof ridge for sealing the container and providing a readily available pouring spout when the contents of the container are to be dispensed. At times, various additional means are provided for enhancing the folding over of the gable roof into a slant top or flat top configuration, retaining the typical pouring spout feature.

Coated paperboard blanks for constructing such a container are made on converting machines similar to those disclosed by Monroe et al. U.S. Pat. No. 2,682,208 and Earp U.S. Pat. No. 3,731,600. After construction, the blanks are processed by forming, filling and sealing machines, such as those disclosed by Monroe et al. U.S. Pat. No. 3,303,761, Allen U.S. Pat. No. 3,918,236, Egleston U.S. Pat. No. 3,398,659 or Young U.S. Pat. No. 4,193,833, to produce the formed, filled and sealed containers of the type referred to above and shown and described in Egleston et al. U.S. Pat. Nos. 3,270,940 and 3,120,335.

A flat top arrangement which does not include a gable top configuration is shown and described in Lisiecki U.S. Pat. No. 4,397,415. The latter arrangement is adaptable to being fully opened at the top to dispense a frozen juice concentrate therethrough.

U.S. Pat. No. 4,422,570 is an example of an improved flat top end closure for a liquid carrying, paperboard container wherein the sealed fin previously used in conjunction with flat end closures is not required, but wherein a pitcher pour spout is included. An external lift tab is integrally formed one outer closure panel for initial lifting of a portion of the pitcher pour spout, and an underlying lift tab is formed on one fold-back closure panel of another portion of the pitcher pour spout, in order to facilitate the opening process.

While the above types of containers have been generally satisfactory for milk and juice products, it is desirable in some instances to utilize a similar square or rectangular thermoplastic coated paperboard container for milk or juices with a flat top closure arrangement which is adaptable to being partially opened to expose an opening on the flat surface, rather than having the conventional pouring spout arrangement integrally formed thereon. Such a container is shown and described in Lisiecki U.S. Pat. No. 4,520,930.

DISCLOSURE OF THE INVENTION

A general object of the invention is to provide a container including improved flat top closure means.

Another object of the invention is to provide a container panels intermediate the body panels and the flat top closure, providing an easily gripped top for non-slip handling.

A further object of the invention is to provide a flat top container including a tamper evident opening feature.

Still another object of the invention is to provide a flat top container including a protected sanitary pouring lip.

Other objects and advantages of the invention will become more apparent when reference is made to the following drawings and accompanying description.

BEST MODE OF CARRYING OUT THE INVENTION

Figure 1:
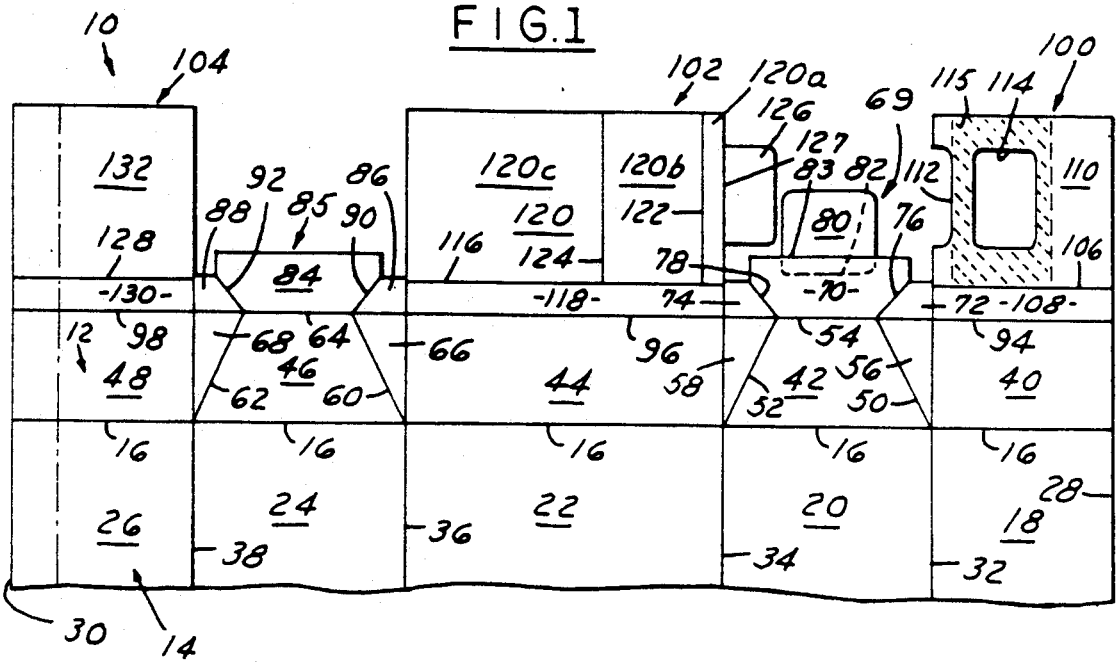
FIG. 1 is a fragmentary layout view of the outside surface of a coated paperboard container blank used to construct a container having a top end closure in accordance with the present invention.

Referring now to the drawings in greater detail, FIG. 1 illustrates a container blank 10 formed in accordance with the principles of the present invention. The container blank 10 is generally divided into three sections including a top end closure 12, a body portion 14, and a flat bottom end closure (not shown). The latter may be any suitable end closure arrangement and is not a part of this invention.

More specifically, aligned score lines 16 extend transversely across the container blank 10 and separate the top end closure 12 and the body portion 14. The body portion 14 comprises a plurality of integrally connected body panels, namely, a first partial side panel 18, a front panel 20, a full side panel 22, a back panel 24, and a second partial side panel 26. The blank 10 is defined on its longitudinal sides by its edges 28 and 30. The body panels 18, 20, 22, 24 and 26 are defined by vertical score lines 32, 34, 36 and 38. The front and back panels 20 and 24 are narrower than the side panels 22 and the combination of partial side panels 18 and 26 and, hence, adaptable to being formed into a rectangular cross-section container.

The top end closure 12 includes connector panels 40, 42, 44, 46 and 48, connected by the aligned score lines 16 to the respective body panels 18, 20, 22, 24 and 26.

Converging diagonal score lines 50 and 52 are formed on the panel 42, extending from the respective intersections of the score lines 32 and 16, and 34 and 16 to predetermined spaced-apart locations on a score line 54 forming the outer edge of the panel 42, forming triangular fold-back panel segments 56 and 58, respectively, at the sides of the panel 42. Similar converging score lines 60 and 62 are formed on the panel 46, extending from the respective intersections of the score lines 36 and 16, and 38 and 16 to predetermined spaced-apart locations on a score line 64 forming the outer edge of the panel 46, forming triangular fold-back panel segments 66 and 68, respectively, at the sides of the panel 46.

The score line 54 serves to connect the edges of the panel 42 and its triangular fold-back panel segments 56 and 58 to a flat top panel 69 consisting of respective adjacent central and corner panel segments 70, 72 and 74, interconnected by diverging score lines 76 and 78. The central segment 70 is separated from a narrow, centered extension segment 80 thereof by a U-shaped perforated line 82 and a score line 83 aligned with the adjacent edges of the central segment 70.

The score line 64 serves to connect the edges of the panel 46 and its triangular fold-back panel segments 66 and 68 to a flat top panel 85 consisting of respective adjacent central and corner panel segments 84, 86 and 88, interconnected by diverging score lines 90 and 92.

Score lines 94, 96 and 98 are aligned with the score lines 54 and 64, and serve to connect the remaining connector panels 40, 44 and 48 with respective flat top panels 100, 102 and 104.

The panel 100 has a score line 106 formed laterally thereacross a predetermined distance from and parallel to the score line 94, dividing the panel 100 into segments 108 and 110, the segment 108 being intermediate the parallel score lines 94 and 106. The segment 110 has a notch 112 formed in the side edge thereof aligned with the vertical score line 32 and a substantially rectangular opening 114 formed therein a predetermined distance from the notch 112. A peelable layer 115 of hot melt or other suitable material, to facilitate the opening process, may be formed around the opening 114.

Figure 7:
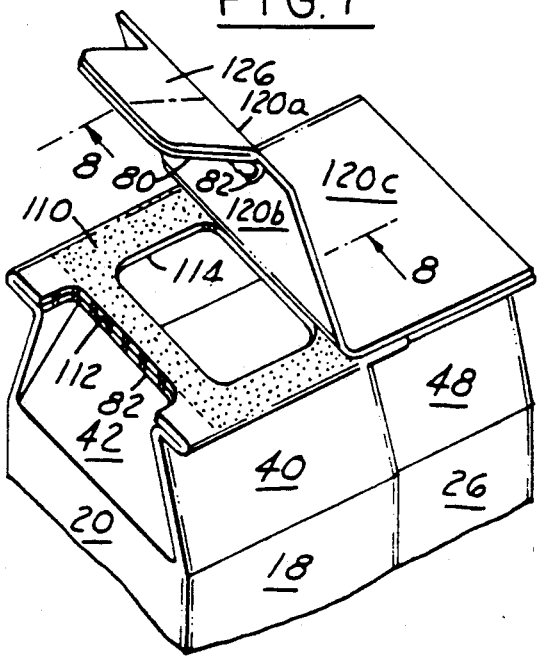
FIG. 7 is a fragmentary perspective view showing the container of FIG. 4 in a completely open condition.

The panel 102 has a score line 116 formed laterally thereacross a predetermined distance from and parallel to the score line 96, dividing the panel 102 into segments 118 and 120, the segment 118 being intermediate the parallel score lines 96 and 116. The segment 120, in turn, has a pair of spaced apart, parallel score lines or partially cut lines 122 and 124 formed thereacross, perpendicular to the score line 116, forming sub segments 120*a*, 120*b* and 120*c*. The portion of the score line 116 between the segment 118 and each of the sub segments 120*a* and 120*b* is cut through, which is more apparent in FIG. 7. The sub segment 120*a* is adjacent the rightmost edge (FIG. 1), on which is formed a lift tab 126, connected thereto by a score line 127.

The panel 104 has a score line 128 formed laterally thereacross, substantially aligned with the score lines 116 and 106, dividing the panel 104 into segments 130 and 132.

Figure 2:
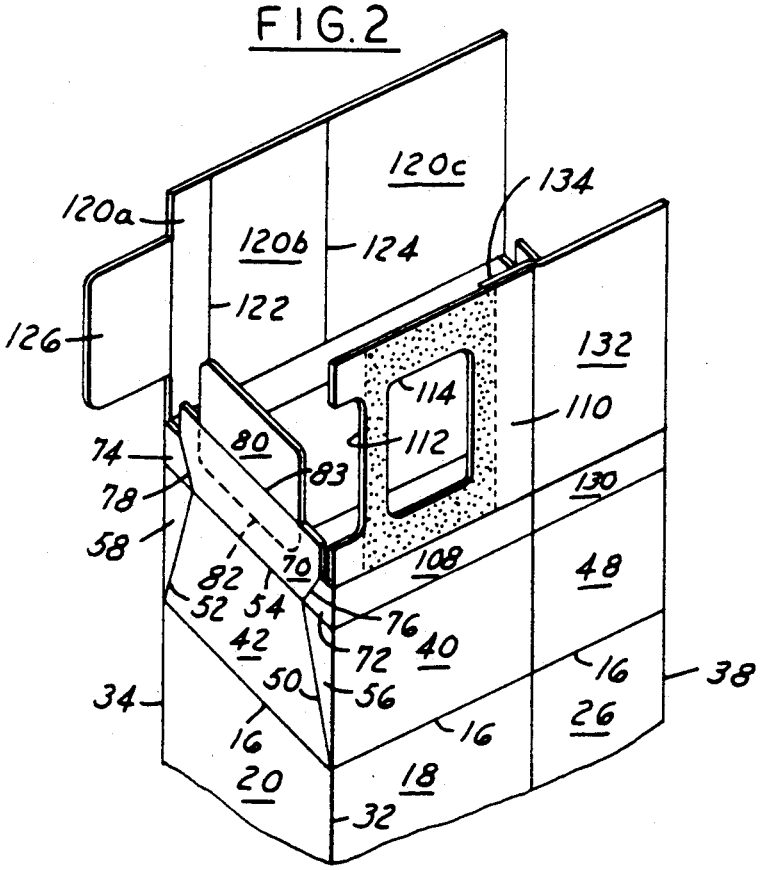
FIG. 2 is a fragmentary perspective view showing the blank of FIG. 1 after it has been side seam sealed into a tubular blank, ready for forming, filling and sealing.
Figure 3:
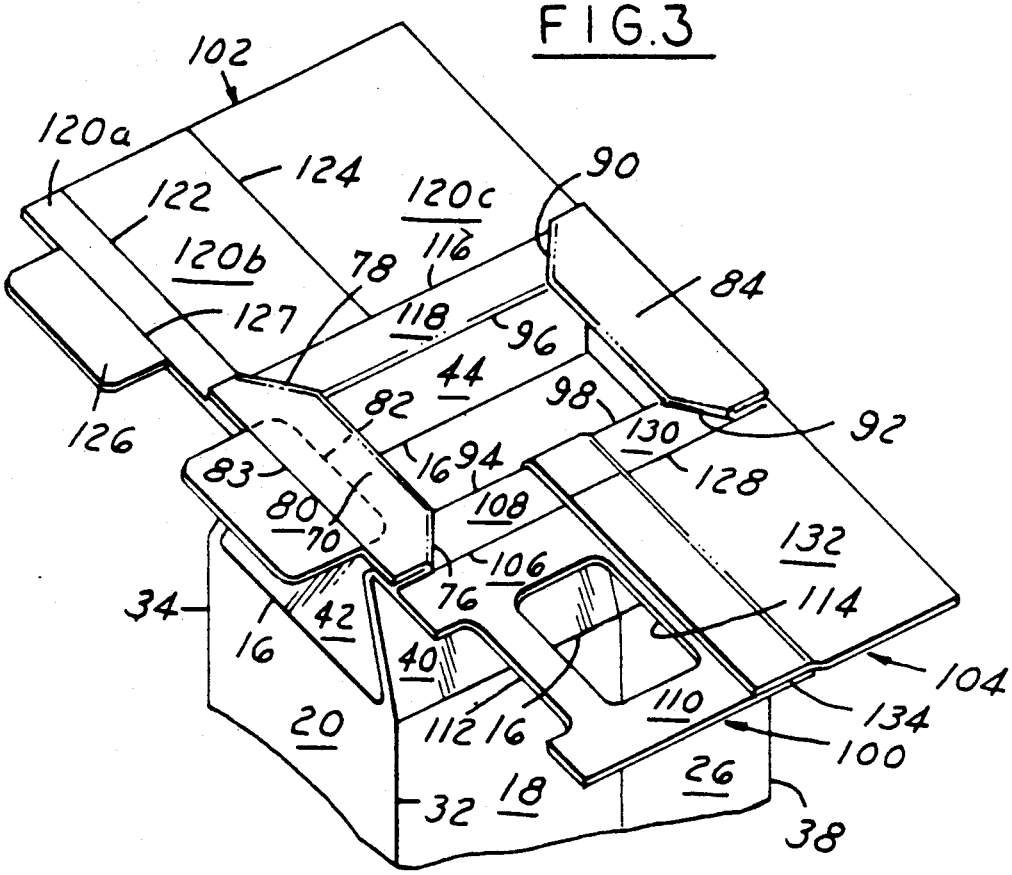
FIG. 3 is a fragmentary perspective view showing the container evolved from the tubular blank of FIG. 2 in a partially closed operational condition.
Figure 4:
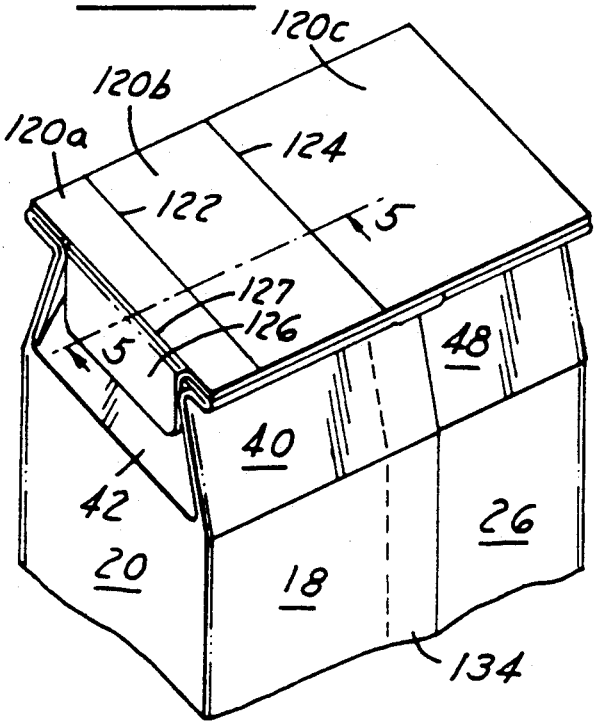
FIG. 4 is a fragmentary perspective view showing the container of FIGS. 2 and 3 in a completely closed condition.

When the blank 10 is formed into the sealed container shown in FIG. 4, it undergoes the intermediate operations shown in FIGS. 2 and 3. As shown in FIG. 2, the blank 10 is formed into a rectangular cross section tube by folding on the vertical score lines 32, 34, 36 and 38. The edge portions of the various vertically aligned panels 18, 40, 108 and 110 overlap and are sealed to the adjacent edge portions of the vertically aligned panels 26, 48, 130 and 132, respectively, forming a side seam therebetween, represented as 134.

As may be noted in FIG. 3, the front and back connector panels 42 and 46 are urged inwardly folding about the score line 16 and the respective pairs of score lines 50/52 and 60/62 to the extent permitted by the side segments 56/58 and 66/68, respectively, with the respective central segments 70 and 84 being bent outwardly about the respective score lines 54 and 64, into a flat configuration. Concurrently, the side connector panels 44 and 40/48 are drawn inwardly, as shown in FIG. 3, and the panel segments 118 and 108/130 are bent outwardly about the respective score lines 96 and 94/98. The corner segments 72, 74, 86 and 88 are folded onto the respective end portions of the segments 108, 118 and 130, beneath the central segments 70 and 84.

Figure 5:
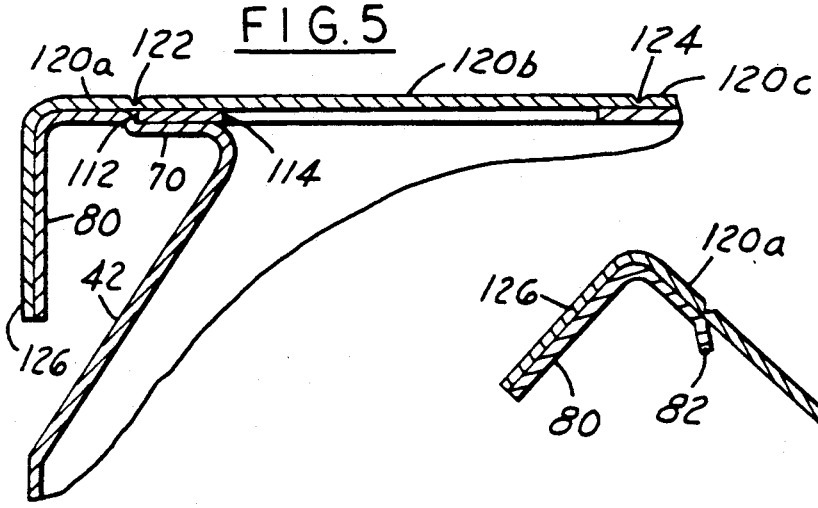
FIG. 5 is an enlarged fragmentary cross-sectional view taken along the plane of the line 5—5 of FIG. 4, and looking in the direction of the arrows.
Figure 8:
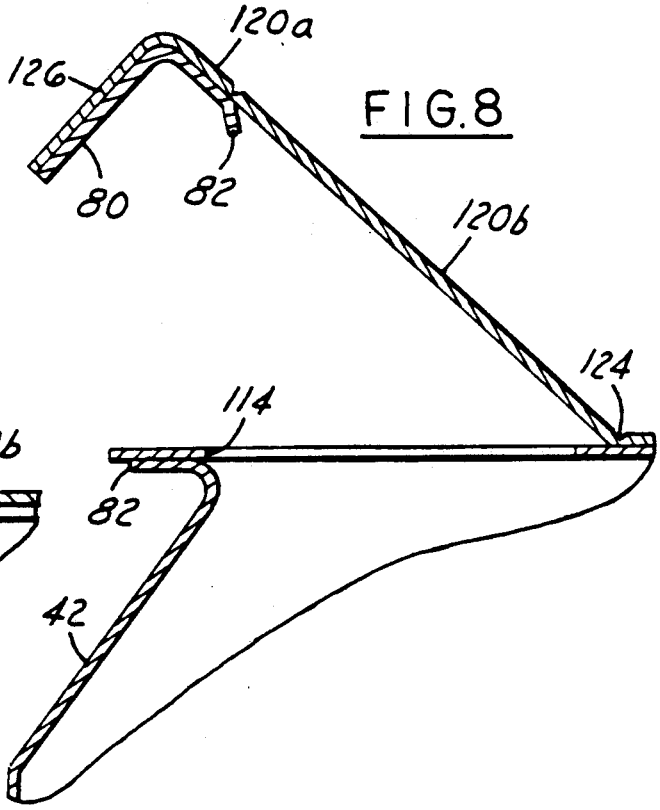
FIG. 8 is an enlarged fragmentary cross-sectional view taken along the plane of the line 8—8 of FIG. 7, and looking in the direction of the arrows.

As indicated with respect to the segments 118 and 108/130, the top panels 102 and combined 100/104 are folded outwardly about the score lines 96, 94/98, and then inwardly about the score lines 116 and 106/128, with the panel 102 overlying the combined panels 100/104, to form the completed top closure arrangement shown in FIGS. 4 and 5, and which is then sealed together by any suitable heating and pressing or vibratory means.

The lift tab 126 is folded downwardly about the score line 127, and sealed in any suitable manner to the underlying extension segment 80, which is also folded downwardly about the score line 83.

Conventionally, prior to forming and sealing the top closure, the bottom closure (not shown), which may be any suitable flat bottom end closure arrangement, is formed and sealed, normally a suitable mandrel, permitting the open-topped container to be filled prior to the above described closing and sealing operation.

Figure 6:
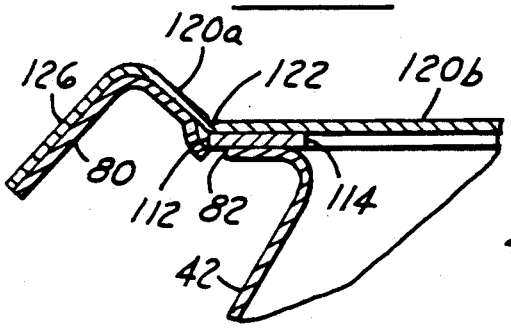
FIG. 6 is a view similar to FIG. 5 in an initial opening condition.

Referring now to FIGS. 5–8, the opening process is illustrated. The combined lift tab 126 and underlying segment 80 is first pulled outwardly, as indicated in FIG. 6, breaking the perforated line 82, and bending about the score line or partially cut line 122. Next, a lifting operation serves to peel the sub segment 120*b* away from the underlying panel segment 110, thereby exposing the opening 114, through which the contents of the container may be poured over a sanitary pouring lip formed with the edge portion of the notch 112.

An alternate top closure embodiment is shown in FIGS. 9–13. Elements of the blank shown in FIG. 9, which are similar to elements of FIG. 1 are represented by the same respective reference numerals. The primary differences lie in a cover panel 136 (FIG. 9) being used in place of the top sub segments 120*a*, 120*b* and 120*c* and the lift tab 126 of FIG. 1, and connected to the segment 118 by the score line 116.

Laterally extending parallel lines 138 and 140, which may be perforated, cut or partially cut through, extend from the edge of the panel 136 which is aligned with the vertical score line 34. If perforated, or cut through, the area surrounding and intermediate the lines 138 and 140 is covered with a sealing film, foil or other suitable coating, represented as 142, to prevent leakage therethrough. The outer ends 144 and 146 of the lines 138 and 140 may diverge outwardly, as shown in the Figures. A score line 148 is formed in the cover panel 136, connecting the inner ends of the lines 138 and 140. There is thus formed a tear strip 150.

A panel segment 152 replaces the central panel segment 70 of FIG. 1. A pouring lip notch 154 is formed in the outer edge thereof, similar in location to the perforated line 82 of FIG. 1.

Figure 11:
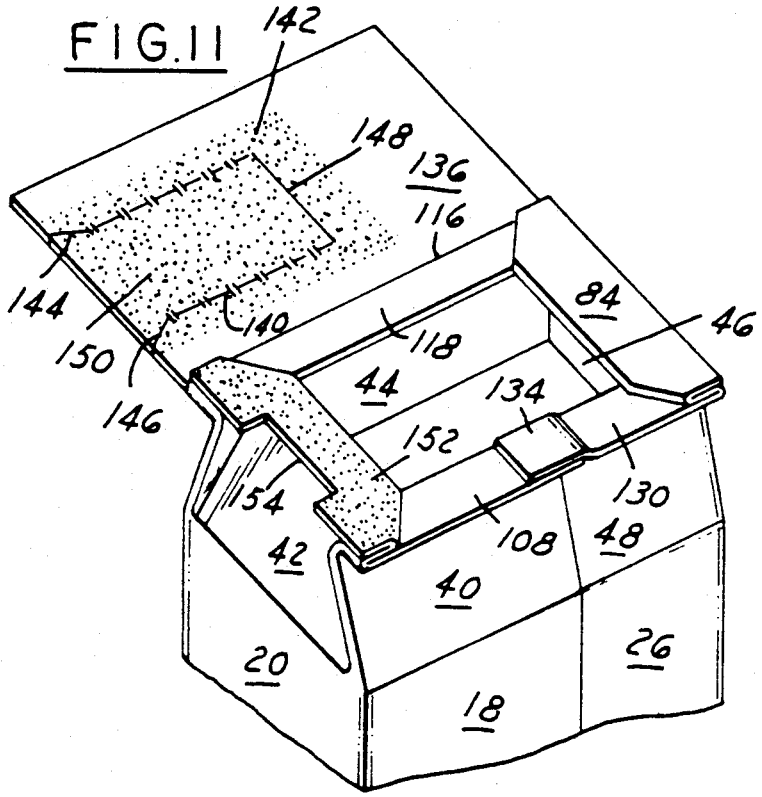
FIG. 11 is a view similar to FIG. 3, and further illustrating the alternate embodiment of FIG. 10.
Figure 12:
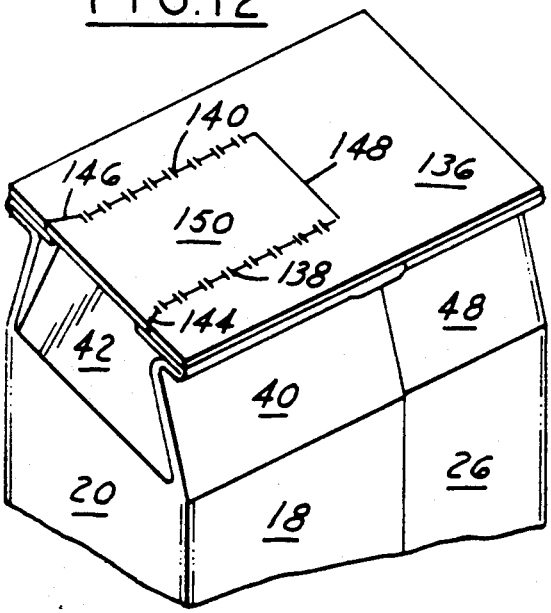
FIG. 12 is a view similar to FIG. 4, and further illustrating the alternate embodiment of FIG. 11.

In this embodiment, the cover panel 136 overlies the front and back panel segments 152 and 84, and the side panel segments 118 and 108/130, as may be noted from FIGS. 11 and 12.

Figure 13:
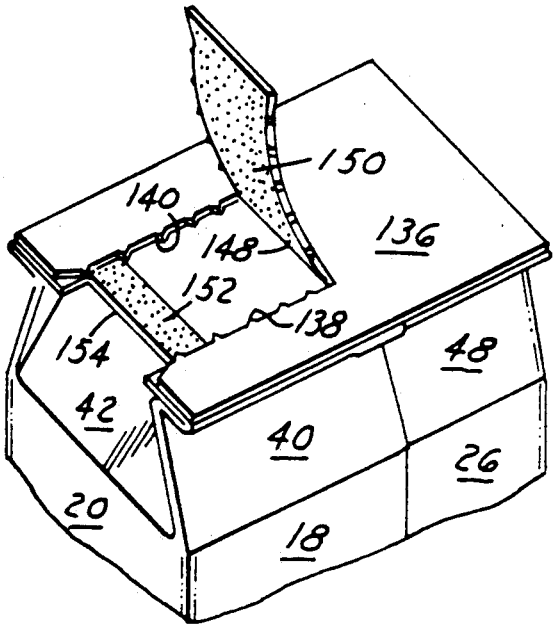
FIGS. 13 and 16 are views similar to FIG. 7, and further illustrating the two alternate embodiments of FIGS. 12 and 15
Figure 14:
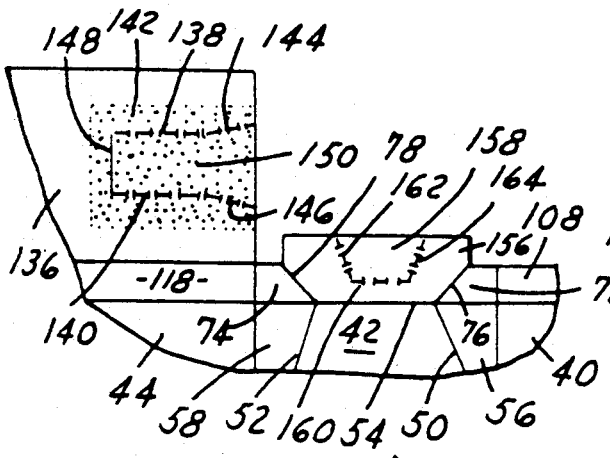
Figure 15:
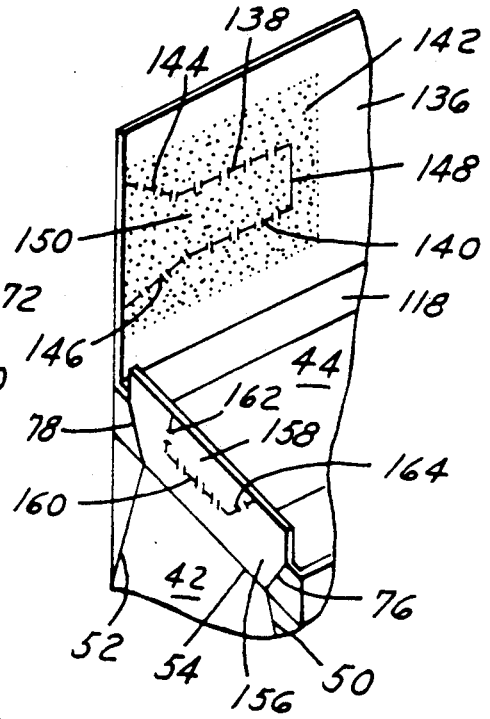

To open the container, the user thereof grasps the edge of the tear strip 150 intermediate the diverging ends 144 and 146 thereof and lifts upwardly breaking the perforated or partially cut lines 138 and 140, as shown in FIG. 13, back to the score line 148, thereby exposing opening therebetween, along a pouring lip formed by the panel segment 152 and the adjacent pouring lip notch 154.

Figure 9:
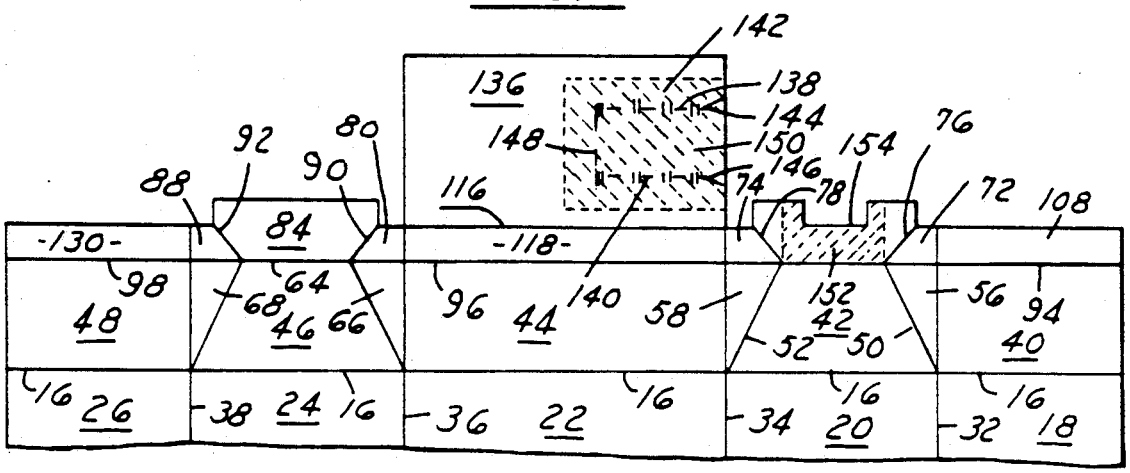
FIGS. 9 and 14 are fragmentary views similar to FIG. 1, illustrating two alternate embodiments of the invention.
Figure 10:
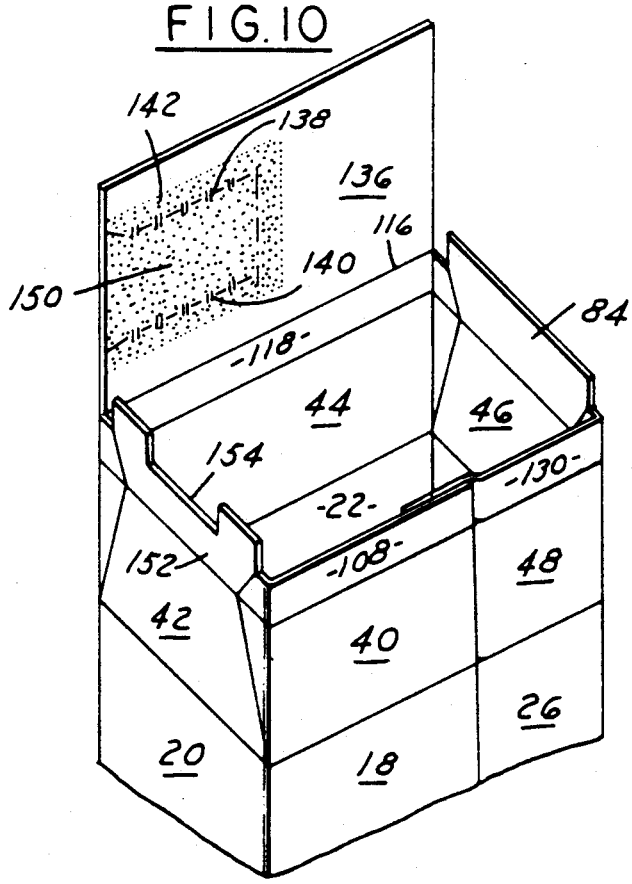
FIGS. 10 and 15 are fragmentary views similar to FIG. 2, and further illustrating the two alternate embodiments of FIGS. 9 and 14.
Figure 16:
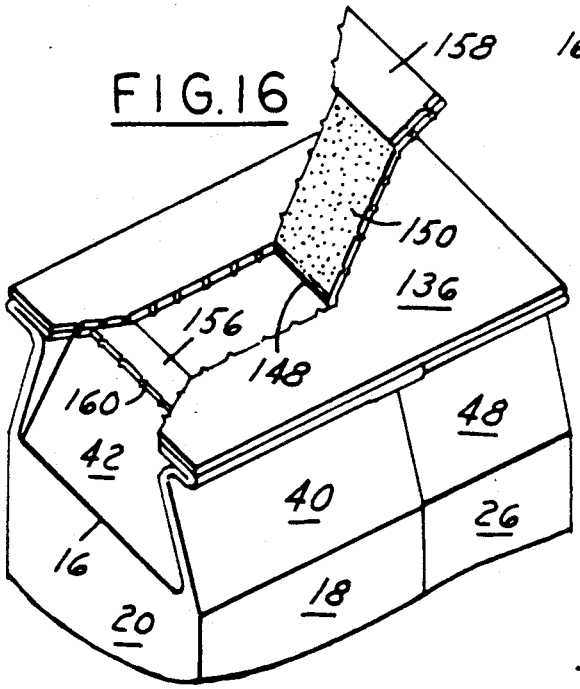

The alternate embodiment shown in FIGS. 14–17 is similar to the FIGS. 9–13 embodiment in all respects except that a panel segment 156 replaces the segment 152 of FIG. 9. The segment 156 includes a solid sub segment 158 in the place of the pouring lip notch 154 of FIG. 9. The sub segment 158 is formed by perforated lines 160, 162 and 164, which resemble the edge of the notch 154 in shape. As indicated in FIG. 16, the sub segment 158 breaks away along the perforations 160, 162 and 164, to be lifted with the tear strip 150, once again providing a pouring lip, over which the contents of the container may be poured.

Figure 17:
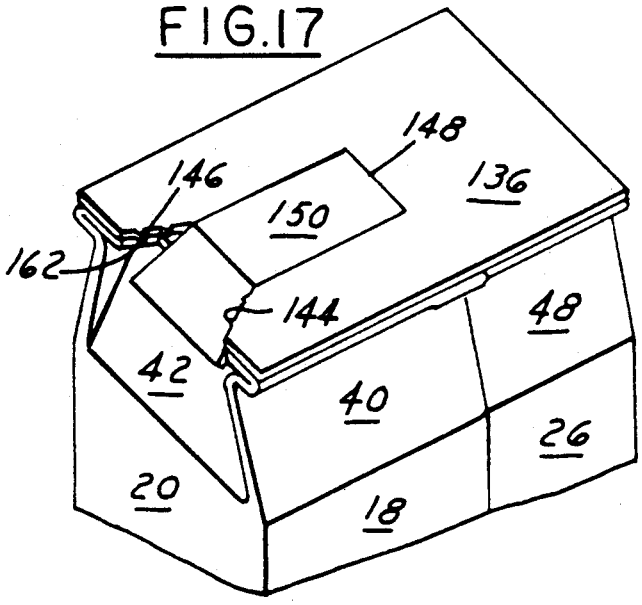
FIG. 17 is a fragmentary perspective view showing the container of FIG. 16 in a reclosed condition after the container has been opened and part of the contents poured therefrom.

As shown in FIG. 17, when the tear strip 150 is closed after the pouring process, the distal end thereof, and the associated sub segment 158 may be pushed downwardly past the broken edges 144 and 146, to form a rather tight and somewhat backed closure for the remaining contents of the container.

INDUSTRIAL APPLICABILITY

It should be apparent that the invention provides a flat top container which includes many desirable consumer features, e.g., an easily gripped top for non-slip handling, a tamper evident opening feature, a protected sanitary pouring lip, and excellent pouring characteristics.

It should be further apparent that, while the drawings are shown to include a center side seam, a conventional corner side seam is feasible for each of the embodiments.

While three general embodiments of the invention have been shown and described, other modifications thereof are possible within the scope of the following claims.

The embodiments of the invention in which an exclusive property or privilege is claimed are defined as follows:

1. In a thermoplastic coated container including body panels including front (20) and back (24) panels and a pair of side (22; 18/26) panels, and four top closure panel arrangements (69; 83; 102; 100/104) connected to the respective front, back and side panels, the improvement comprising front (42), back (46) and a pair of side (44; 40/48) connector panels, a pair of score lines (50, 52; 60, 62) formed on each of the front and back connector panels and converging away from the respective front and back panels forming a central panel (42; 46) and triangular fold-back panels (56; 58; 66, 68) thereon, fold-out panel segments (118; 108/130; 70, 72, 74; 84, 86, 88) connected to each of said side connector panels, said central and said triangular fold-back panels, a pair of diverging score lines (76, 78; 90, 92) formed on each of said fold-out panel segments connected to said central and triangular fold-back panels forming a central panel segment (70; 152; 156) and adjacent corner segments (72, 74; 86, 88) thereon, a non-perforated cover panel (120*a*, 120*b*, 120*c*; 136) formed to extend from one of said side fold-out panel segments, and opening means formed on said cover panel adjacent said front connector panel (42) including a lift tab (126) formed on said cover panel (120*a*, 120*b*, 120*c*), a centered extension segment (80) formed on said front central segment (70) underlying said lift tab, and a perforated line (82) formed on said front central segment adjacent said centered extension segment.

2. In the container described in claim 1, and a further flat top panel (110, 132) formed to extend from the other of said side fold-out panel segments, a notch (112) formed in said further flat top panel adjacent said centered extension segment (80), and an opening (114) formed in said further flat top panel a predetermined distance from said notch, forming a pouring lip therebetween and underlying said cover panel (120*a*, 120*b*, 120*c*).

3. In the container described in claim 1, and parallel score lines (122, 124) formed across said cover panel (120*a*, 120*b*, 120*c*) and spaced predetermined distances apart from said lift tab (126).

4. In the container described in claim 1, wherein each of the group of one of said pair of side panels, the adjacent connector panel, and the adjacent fold-out panel segment is formed of two partial width panels connected together by an overlapping side seam.

5. In the container described in claim 2, and a peelable layer (115) of hot melt formed around said opening (114) to facilitate the opening process.

6. In the container described in claim 1, wherein said notch (112) aligns with said perforated line (82) formed on aid front central segment (70).

* * * * *